US005918983A

United States Patent [19]

Palazzolo

[11] Patent Number: 5,918,983

[45] **Date of Patent: *Jul. 6, 1999**

[54] SECURITY ENVELOPE

[75] Inventor: John Palazzolo, Milford, Ohio

[73] Assignee: Control Paper Co., Inc., Cranford, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 08/745,952

[22] Filed: Nov. 8, 1996

[51] Int. Cl.[6] ..... B65D 33/34

[52] U.S. Cl. ..... 383/5; 383/61; 383/78; 383/93

[58] Field of Search ..... 383/5, 78, 83, 383/84, 85, 88, 89, 61, 93

[56] References Cited

U.S. PATENT DOCUMENTS

| | | | |
|---|---|---|---|
| 2,819,010 | 1/1958 | Amiguet . | |
| 2,991,001 | 7/1961 | Hughes . | |
| 3,473,725 | 10/1969 | Wiehahn . | |
| 4,180,929 | 1/1980 | Schultz, Jr. | 40/2.2 |
| 4,189,050 | 2/1980 | Jensen et al. | 383/84 X |
| 4,510,621 | 4/1985 | Sak et al. . | |
| 4,557,505 | 12/1985 | Schaefer et al. | 383/5 X |
| 4,709,397 | 11/1987 | Voshall et al. . | |
| 4,759,643 | 7/1988 | Canno . | |
| 4,838,708 | 6/1989 | Holcomb et al. . | |
| 4,932,791 | 6/1990 | Vetter . | |
| 4,941,196 | 7/1990 | Edelman et al. | 383/5 |
| 5,077,001 | 12/1991 | Makowka | 383/5 |
| 5,205,649 | 4/1993 | Fullerton | 383/78 X |
| 5,318,364 | 6/1994 | Raden . | |
| 5,352,041 | 10/1994 | Fullerton et al. . | |
| 5,549,388 | 8/1996 | Wilkes . | |
| 5,620,256 | 4/1997 | Makrauer | 383/5 |

FOREIGN PATENT DOCUMENTS

| | | | |
|---|---|---|---|
| 0134129 | 3/1985 | European Pat. Off. . | |
| 0341699 | 11/1989 | European Pat. Off. . | |
| 393841 | 10/1990 | European Pat. Off. | 383/5 |
| 0396428 | 11/1990 | European Pat. Off. . | |
| 332528 | 8/1930 | United Kingdom . | |
| 1470786 | 4/1977 | United Kingdom . | |
| 1559472 | 1/1980 | United Kingdom . | |
| 2051003 | 1/1981 | United Kingdom . | |
| 2120638 | 12/1983 | United Kingdom . | |
| 2145997 | 4/1985 | United Kingdom . | |
| 2149381 | 6/1985 | United Kingdom . | |
| 2200337 | 8/1988 | United Kingdom . | |
| 2211760 | 7/1989 | United Kingdom . | |
| 2265883 | 10/1993 | United Kingdom . | |
| WO 91/04199 | 4/1991 | WIPO . | |

*Primary Examiner*—Jes F. Pascua
*Attorney, Agent, or Firm*—Edward Dreyus

[57] ABSTRACT

A security envelope for transporting valuable documents and articles includes a thin header formed of thin frangible material secured to the back panel having an adhesive layer that seals the header to the front panel upon folding and pressing closed. An inner layer of adhesive on the inner surface of the back panel seals the inner front and back panel surfaces to close the envelope chamber and extends further toward the envelope bottom than the header adhesive layer when sealed to prevent tampering tool access to the envelope chamber. Application of tampering heat will shrivel the header and cold sufficient to release the inner adhesive layer will cause pieces of the outer adhesive layer to break off and fall away. Printed indicia on the header inner surface and a transparent flood coat on the inner header surface will adhere to the header adhesive layer and aid in the tampering attempt indication.

26 Claims, 5 Drawing Sheets

SECURITY ENVELOPE

BACKGROUND

The present invention relates to envelopes and more particularly to security envelopes or bags that impede tampering after the envelope had been closed and/or that indicate to the recipient that tampering had occurred after the envelope had been closed. These envelopes have particular utility in the transportation and handling of valuable items such as paper currency, checks, and other documents of value. Because of the enormous number of shipments of these types of documents arriving daily at banks and other entities for processing, it is common for the respective recipient entity to standardize the transport envelope used to convey documents and things to such recipient entity. For example, a bank normally purchases thousands of envelopes of the same design and supplies them to its customers to use in shipping money and documents to such bank. The outside of the envelope normally bears indicia prompting the sender to write the name of the sender, its account number with the bank, and the contents or total values within the envelope in cash, checks, and other documents.

Because of the nature of the transaction, once the recipient opens the envelope, the recipient becomes liable for any shortfall in the monetary contents placed in the bag by the sender. Consequently, the recipient has the duty to examine an arriving envelope carefully for any signs of tampering and either refuse to accept or return to sender unopened an envelope bearing signs of tampering.

Improvements have been made to envelope materials and designs to facilitate visual detection of safety envelopes of this nature. These prior improvements include (1) forming the envelope of high shear, impact resistant material that folds in half and enables heat sealing of two side edges other than the mouth of the envelope, (2) employing a tamper evident sealing strip that overlies the envelope flap that closes the envelope mouth, the seal having indicia that is supposed to distort upon tampering, which distortion is said to be easily discernible by the recipient upon visual inspection or (3) employing a closing system two vertically displaced sealing strip arrangement, the first to seal the mouth cover flap firmly to the envelope outer surface and the second to seal over the flap free transverse edge to the envelope outer surface and show tamper evidence if the second seal is tampered with and the flap edge is lifted. See U.S. Pat. Nos. 4,082,880, 4,483,018, 4,932,791, and 5,077,001, incorporated herein by reference, for examples of prior designs and purported envelope improvements.

Another known safety envelope, depicted in FIGS. 8–10, includes a series of laterally spaced openings 1 on the envelope front panel 3 near the envelope mouth or lip. A layer of adhesive 2 is located laterally across the inner surface of the back panel 4 opposite openings 1. Header 5 includes section 6 secured to the outer upper surface of back panel 4 by adhesive layer 8 and a section 7 extending beyond the top of panel 4.

A release liner 9 overlies layers 2 and 8. Header 5 is made relatively thick and consists of polyethylene material. Also, the bottom of layer 8 is equal with or above the bottom of layer 3. The user places the contents in the envelope, removes release liner 9, folds header 5 over to a dotted line printed on the front panel so that the free edge of layer 8 lies at or above the bottom of layer 2 and presses the parts together thus forcing layer 2 in contact with layer 8 through openings 1. Parts of layers 2 and 8 also adhere to the inner and outer surfaces of panel 3.

Notwithstanding prior designs, tampering continues to be a major problem with all known safety bags or envelopes. For example, successful tampering has been practiced on tamper indicating envelopes by a variety of commonly available products.

Tampering techniques include applying cold gas or fluids to the outer plastic surfaces of sealing flaps and plastic strips across all or a part of the envelope mouth. Such gas is readily available from commonly purchased consumer products such as aerosol spray cans and the like. When chilled, the adhesive becomes brittle and temporarily loses its adhering properties. The flap or strip is then opened, contents removed and flaps re-closed when the adhesive reaches room temperature. Those known bags with plastic breakable or tearable sealing means can be simply reinforced with plastic adhesive tape until they are resealed at or near room temperature. Once resealed, the tape can be simply removed.

Other techniques include using heat from a common hair dryer, a very sharp knife or pointed blade edge, or by simply peeling back the protecting flap or layer very slowly and carefully and doctoring any visual indicator that may arise. Solvents and long thin tools have also been used to defeat the envelope integrity.

SUMMARY OF THE INVENTION

The present invention provides a new plastic security envelope with a tamper impeding and evident sealing arrangement that avoids the foregoing problems and provides other and further benefits.

The sealed envelope, in one exemplary embodiment according to the inventive principles, includes a plastic safety envelope that comprises an internal layer of pressure sensitive adhesive extending laterally across and between for sealing together the inside surfaces of the front and back panel portions that define the envelope mouth. This internal layer in cooperation with the envelope panel internal surfaces closes and seals the envelope chamber. A header adhered to the outside surfaces of the front and back panel portions defining the envelope mouth preferably, the internal adhesive layer extends below the external adhesive layers. With this arrangement, a tamper tool or knife edge that penetrates the front or back panel at the header location will simply encounter the internal adhesive layer instead of entering the envelope chamber and having access to the contents. The tool cannot penetrate the internal adhesive layer into the chamber without major destruction of the front or back envelope panel, which would be easily detected even if the header were resealed.

Additional objects, features, and benefits include a single release liner covering and protecting the internal adhesive layer and adhesive layer portion that will contact the front outer surface of the front panel when the header is pressed sealed. When the release liner is removed the safety bag automatically closes and seals the chamber because the internal adhesive layer need only touch the other panel to adhere to it. Therefore, the envelope chamber is effectively closed before the header seal is folded over.

The internal adhesive layer extends below or further toward the envelope bottom than the lower boundary of the outer adhesive layer portions on the outer surfaces of the front and back panels. To seal, the header is folded over so that its free edge is positioned to assure the upper boundary of the upper adhesive portion is positioned above the lower boundary of the internal adhesive layer. This cooperation of the adhesive internal and external adhesive layers further assures tamper protection against entry of a tamper tool.

Indicia are printed on the outer surface of the front panel to aid the sender in properly locating and positioning the free end of the header before press sealing the envelope closed.

Since the header performs a sealing function and is not relied upon for strength to close the envelope as in prior known devices, the header is made of frangible material that becomes more frangible when chilled. Accordingly, an embodiment includes a header made out of thin transparent frangible material, such as acetate and having indicia printed on its underside that indicates a tampering event. Once sealed, application of moderately cold gases or fluids or other freezing devices will cause the adhesive layer under the header to release, if the header is reinforced as described above.

A further feature of the embodiment includes forming the header from clear transparent acetate so that the layer below can be seen by the recipient. The header includes first repetitive indicia printed on the inner header surface in a first color. A second printing that is flood coat in a second color is then printed (inked) over the substantially entire inner surface of the header including the first printed indicia. The glue or adhesive layers mentioned above can be tinted with a different third color. This causes colors to visually process together making a fourth color. If cold tampering after sealing can successfully raise any sealed portions of the acetate header the header adhesive remains on the outside of the envelope panel and overlying the internal adhesive layer. The ink from one of both layers of ink will unevenly separate from the acetate and remain unevenly on the exposed outer adhesive layer top surface. This ink yields many beneficial effects, including the ink prevents aggressive resealing of the header where the ink remains on the adhesive layer which is easily detected by the recipient. If, somehow, resealing the header is accomplished, a variety of random colors will appear through the clear header because it will be virtually impossible to lay the header back down and match up all the places where the first printed ink remained and the second did not, where no ink remained and where all ink remained on the header when tampering occurred. An alternative embodiment includes printing the flood coat on the header outside surface instead of the inner surface so that missing header pieces resulting from cooling and tearing the header/adhesive layer can be clearly seen.

Furthermore, if tampering after sealing can successfully raise any sealed portions of the acetate header, the chamber is still sealed closed by the internal adhesive layer and cooperating envelope panels. A further chilling fluid application must be applied directly on to the exposed outer adhesive layer in order to chill the inner adhesive layer. This causes the outer adhesive layer to break and flake. Adhesive parts will then drop off or be blown away and will be evident even if the header is replaced in tact.

DRAWINGS

Other and further objects and advantages will become apparent from the following detailed description of an exemplary embodiment according to the invention when taken with the appended drawings in which.

DETAILED DESCRIPTION OF EXEMPLARY EMBODIMENT

Figure 4:
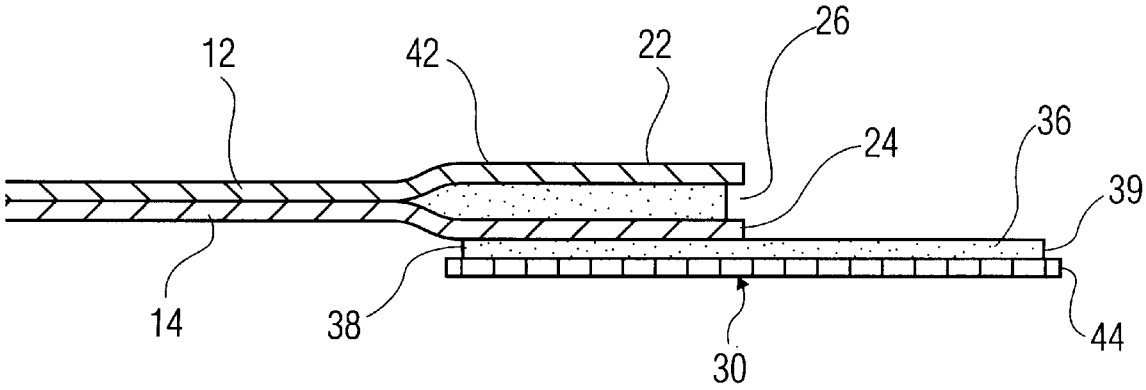
FIG. 4 is the same as FIG. 3 with the front panel mouth portion pressed against the internal adhesive layer.
Figure 5:
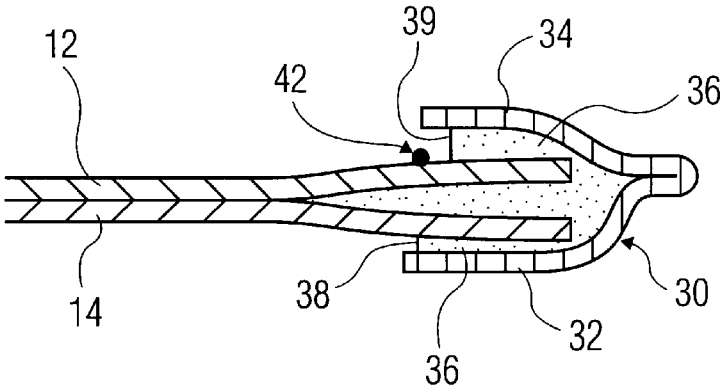
FIG. 5 is the same as FIG. 4 with the header folded over and the upper header portion pressed against the outer surface of the front panel.
Figure 6:
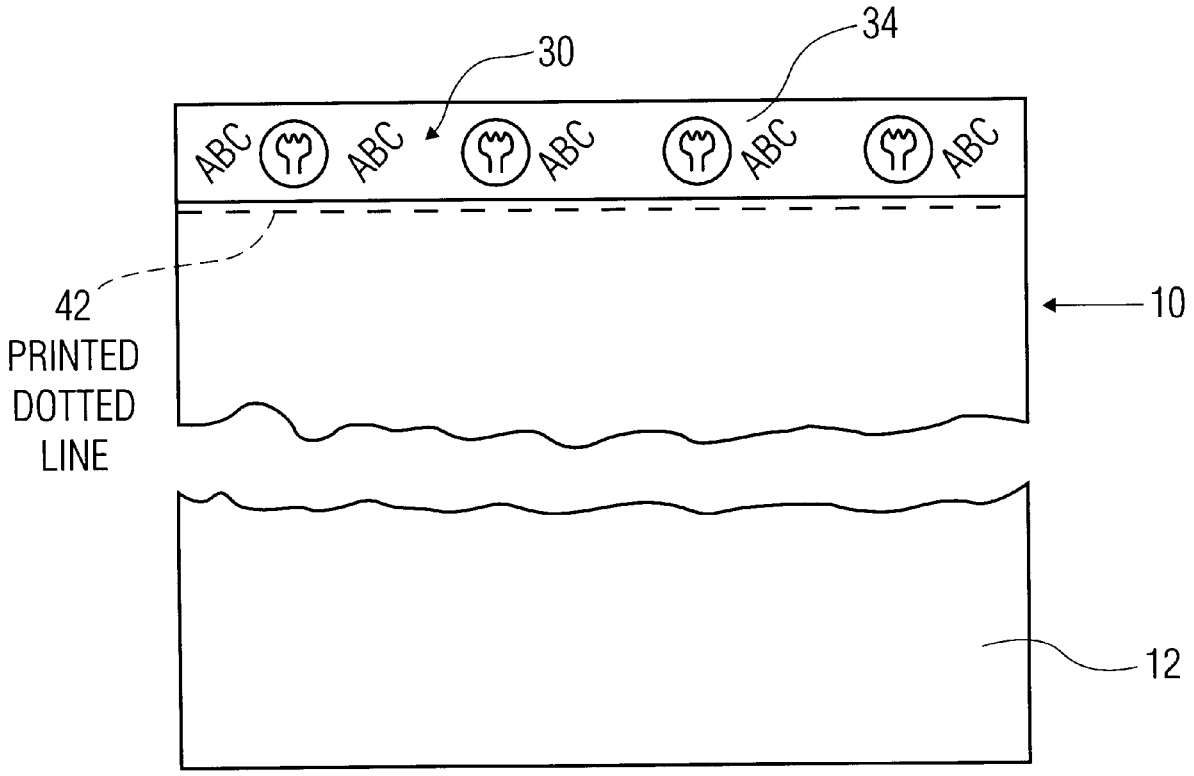
FIG. 6 is a front elevation of envelope 10 of FIG. 5.

With reference to FIGS. 1–5, envelope 10 according to the principles of the present invention includes a front panel 12 and a back panel 14 formed of any suitable conventional material such as monolayered or co-extruded plastic. Panels 12 and 14 can be formed from a single stock sheet, folded at 16 and thermally treated or sealed together along and/or near side edges 18 to form the internal envelope chamber 20. A fold line 42, better seen in FIGS. 4 and 6, is printed on the front of panel 12 to aid the user in where to place the free end of the header upon sealing. Line 42 is positioned above the lower edge of layer 26.

Panels 12 and 14 include envelope mouth defining portions 22 and 24 through which documents and other items can be placed into chamber 20. It should be understood that portion 22 is shown lifted up in FIGS. 1, 2, and 3 and release liner 37 shown broken for clarity. Normally portion 22 lies contiguous to and touching the lower part of release liner 37 described below and liner 37 extends the full lateral dimension of portion 24.

An internal layer of hot melt adhesive 26, placed on the inner surface of portion 24 during the manufacturing process and before folding panels 12 and 14 and heat sealing of edges 18, extends laterally across the envelope. The top edge of layer 26 can be spaced slightly below the top edge 28 of portion 24.

Figure 7:
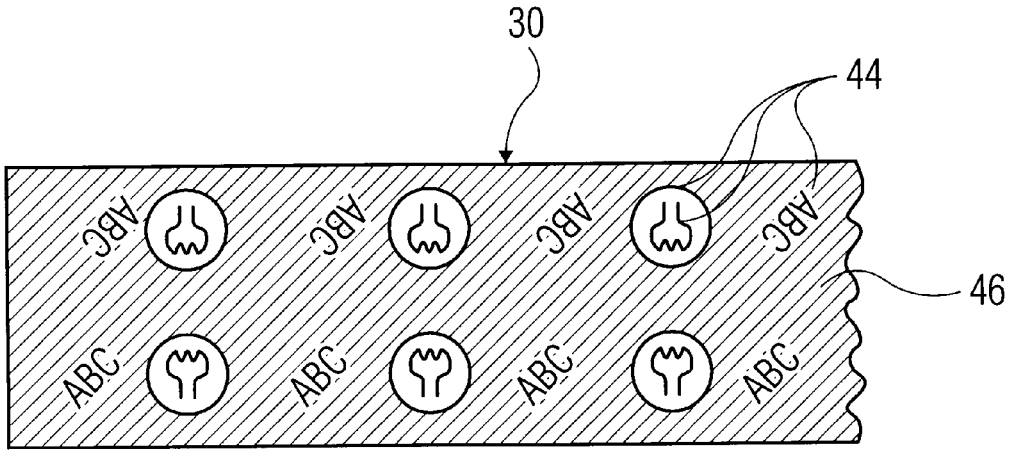
FIG. 7 is a top plan view of header 30, with parts broken away, after printing is completed but before adhesive is applied.
Figure 8:
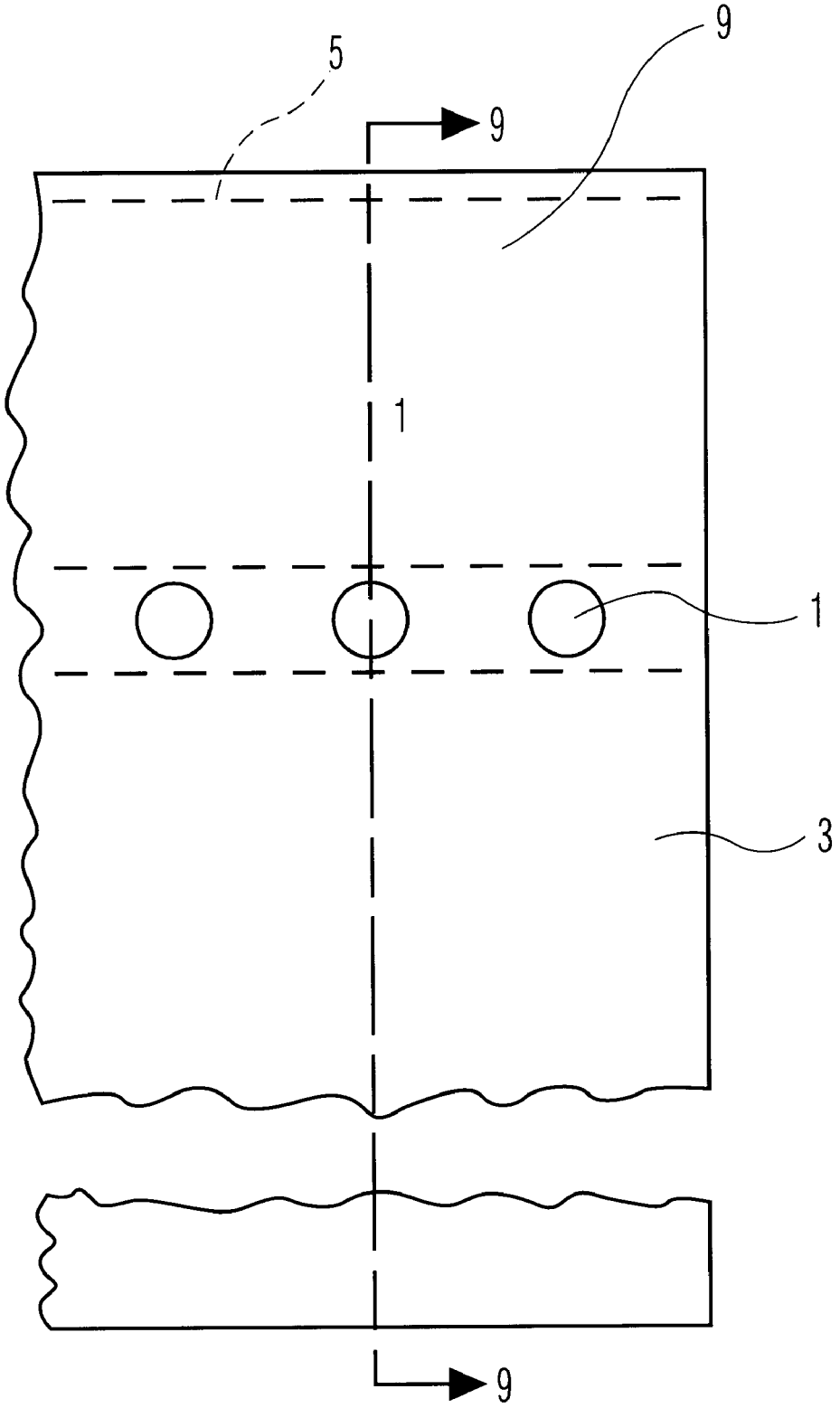
FIG. 8 PRIOR ART
FIG. 8 is a front elevation, with parts broken away, of a prior known safety envelope.
Figure 9:
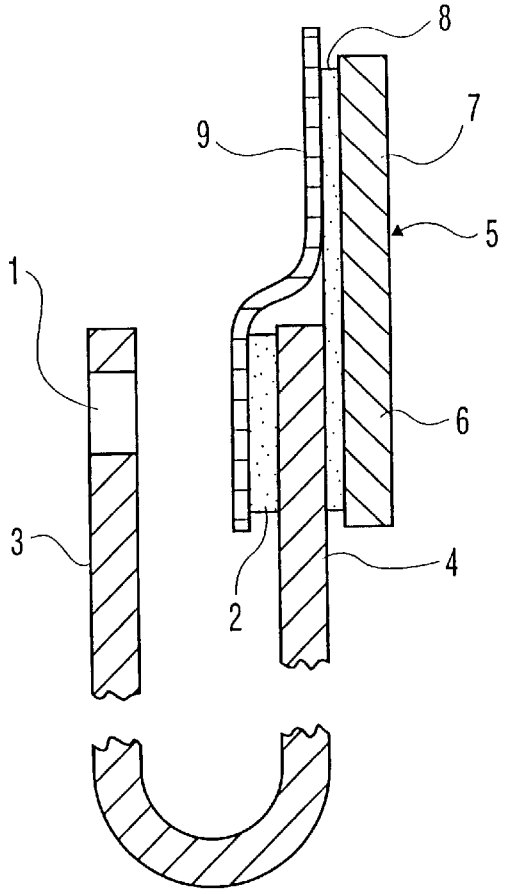
FIG.9 PRIOR ART
FIG. 9 is a side sectional view taken along line 9—9 of FIG. 8.
Figure 10:
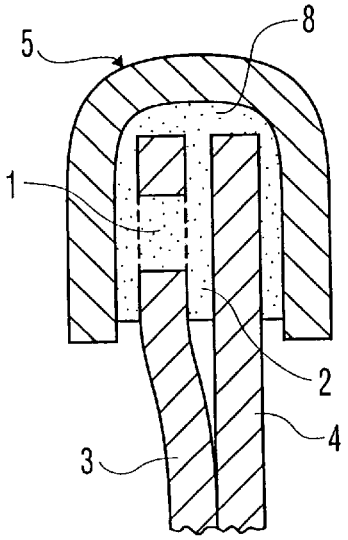
FIG.10 PRIOR ART
FIG. 10 is a view of the envelope sealed mouth portions of the envelope of FIG. 8 after the envelope is sealed.

Envelope 10 in its pre-closed condition further includes header 30 that includes a back panel section 32 and a front panel section 34. Because the adhesive layer 26 functions to close the chamber in cooperation with the internal surfaces of the front and back panels, header 30 can be and is made of thin, frangible material such as acetate or other suitable material. In one example embodiment, the header is one-one thousandth of an inch thick and made of clear, transparent acetate. During manufacture, the inner surface of header 30 is corona treated and indicia such as symbols, circles, and letters ("ABC"), represented as 44 in FIG. 7, is printed on the inner surface of the header. Thereafter, a translucent flood coat shown as shading 46 is printed over the entire inner surface of header 30 including the indicia 44. The ink used for indicia 44 can be of a first color, such as black or dark blue, and the ink used for flood coat 46 can be of a second color, such as yellow, and the adhesive layer 36 should be tinted with a third color, such as red, to provide the tamper evident functions described above. The second and third colors process together to indicate visually a fourth color, green, to the recipient under normal conditions. If panel portion 22 is opaque, it is less important for layer 26 to be tinted the third color but if portion 22 is clear, then layer 26 should not be tinted at all or tinted a fifth color.

Alternatively, but less desirable, the translucent flood coat can be applied to the outer surface of header 30, which has not been corona treated. The outer flood coat would not release from the outer header surface and if cold is used to release the header 30 from layer 36 and frangible pieces of header 30 breakaway, then the visual discontinuity of the resealed header can be more easily detected and doctoring made more difficult.

During manufacture, a frangible hot melt adhesive layer 36 is applied to header 30 generally as shown and header section 32 is pressed against the outer surface of back panel portion 24 to fix header 30 thereto with section 34 and layer 36 extending beyond the top edge 28 of portion 24. Once header 30 is fixed to panel portion 24, release liner 37 is applied to releasably cover layers 26 and 36 and protect these layers from unwanted adhesion to other objects, documents and portion 22. Like layer 26, layer 36 preferably extends laterally across the width of back panel portion 24. Liner 37 can be made of polyethylene for easy release from adhesive layers 26 and 36.

Alternatively, the portion of layer 36 contacting portion 24 can first be applied to portion 24 and header 30 subsequently affixed thereto. Then, layer 26 and the portion of layer 36 extending beyond portion 24 could be first applied to release liner 37 and then liner 37 placed into position shown in FIG. 2.

As better seen in FIG. 2, lower edge or lowest boundary 40 of layer 26 extends or is preferably located below or further toward the bottom of envelope 10 than the lower edge or lowest boundary 38 of layer 36 and the dotted line 42 printed on portion 22.

Figure 1:
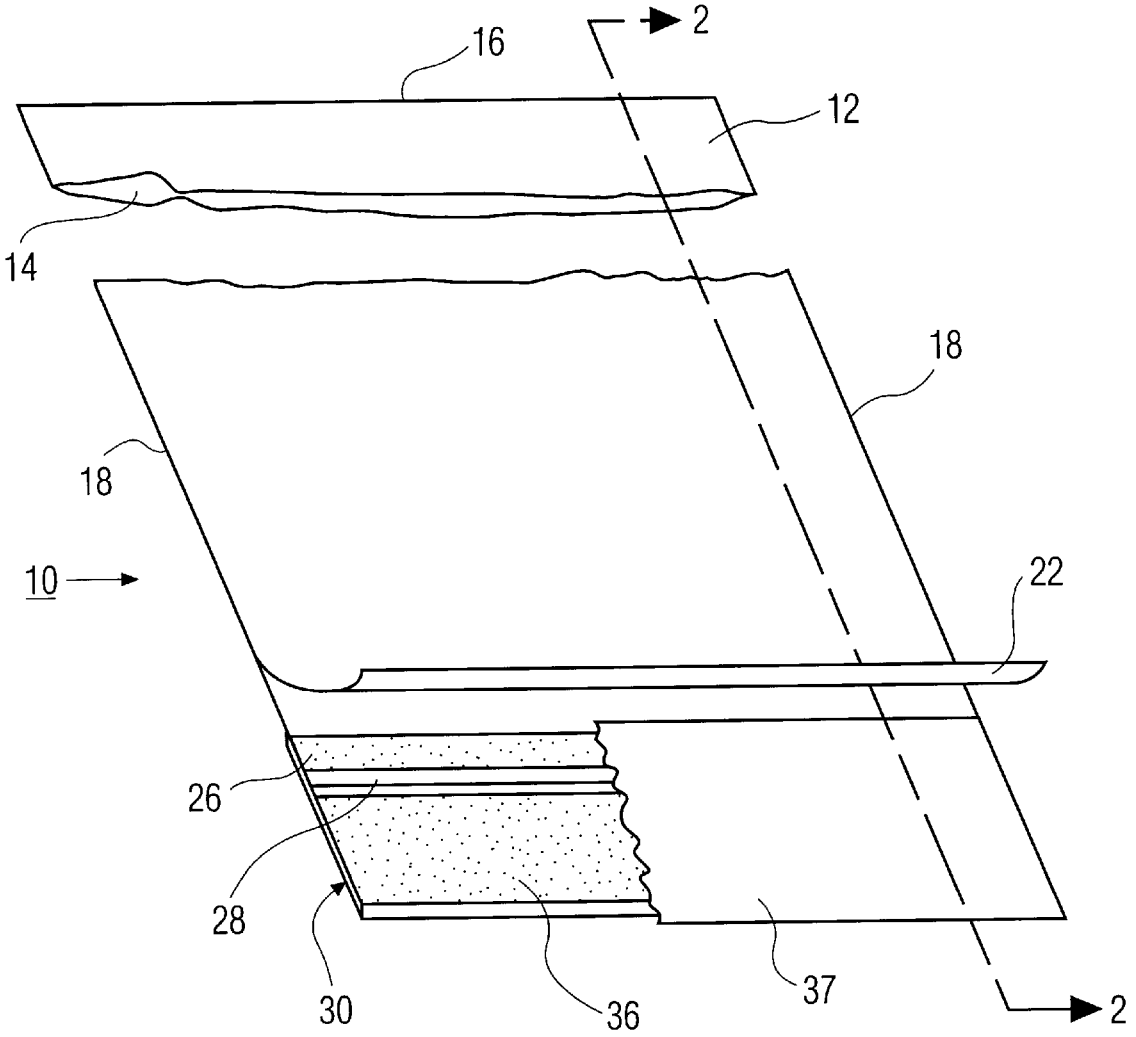
FIG. 1 is a pictorial perspective representation, with parts broken away, of one example envelope according to the principles of the present invention prior to closing and sealing of the header.
Figure 2:
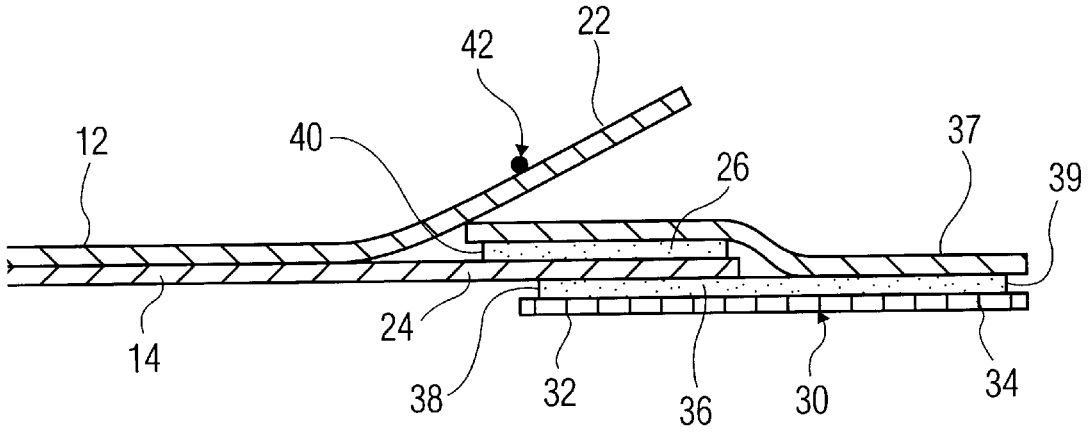
FIG. 2 is a side sectional view taken along line 2—2 of FIG. 1.
Figure 3:
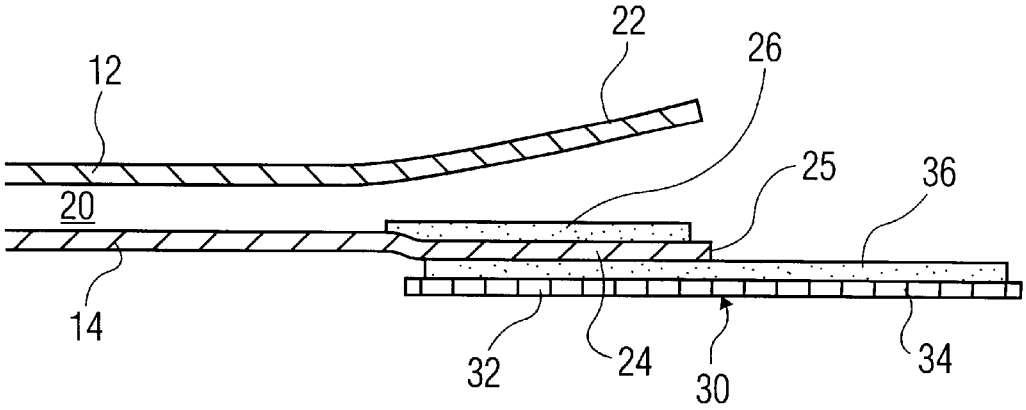
FIG. 3 is the same as FIG. 2 with the release liner removed.

During operation, the user acquires envelope 10 as shown in FIG. 2. The user opens the envelope mouth and places documents and/or items in chamber 20. To close and seal, the user first removes release liner 37 to expose internal layer 26 and the top portion of header layer 36. See FIG. 3.

Without further effort, portion 22 contacts internal adhesive layer 26 to close and seal chamber 20. See FIG. 4. Hand pressure can be applied to the outside of portion 22 to further enhance the sealing together the internal surfaces of portion 22 and 24. Next, header 30 is folded over the envelope mouth until the free header edge 44 is generally aligned with the horizontal visual indicator 42 printed on the outside surface of portion 22. The user then presses header section 34 to compress together in overlying relation portions 22, layer 26, portion 24, header sections 32 and 34 and their respective portions of layer 36. As seen in FIG. 5, panel portions 22 and 24 are sealed together to close chamber 20 with internal layer 26 that is internal to the envelope panels and header 30 is sealed to the front and back panels by layer 36 and with the internal adhesive lowest boundary 40 further toward the envelope bottom than the lowest boundary 39 of external adhesive layer 36, generally as shown. With this arrangement, a tamper tool that penetrates section 34 and panel portion 22 or section 32 and panel portion 24 will encounter internal adhesive layer 26 and can not gain entrance to chamber 20.

If a tampering person uses heat on the header, the thin acetate header 30 will shrivel up, contract, or distort leaving a visual indication aided by the spots at which indicia 44 and coat 46 ink had pulled from header 30 and remains on layer 36. Air bubbles and discoloration tend to form. If cold fluids or devices are used, the thin acetate becomes frangible and will tear or crumble when the peel-back or lifting is attempted. In the unlikely event the header peel-back is successful, layer 36 will separate from header 30 and remain on the outer surface of the envelope. However, the envelope mouth remains closed and sealed by layer 26. If further freezing is applied to freeze layer 26, excessive freezing must be applied to layer 36 that overlies layer 26. This excessive freezing causes parts of layer 36 to crack, break up, and fall or be blown away from the outer envelope surface. Therefore, even if the header can be replaced in tact back on to layer 36, parts of layer 36 would be missing and clearly seen by the color discontinuities described above. In addition, the indicia 44 or coat 46 ink will randomly pull from header 30 and remain on layer 36 so when header 30 is repressed on layer 36 air bubbles and discoloration tend to form under the lifted portions of the header. Plus, various colors will tend to appear such as the first, second, third in various irregular spots or shadow locations to clearly indicate tampering. It is virtually impossible to correct such indications by doctoring.

In the embodiment where the translucent color flood coat is printed on the header outside surface, pieces missing from the thin header will easily expose the spots of missing flood coat and because of the underlying indicia patterns and tinted layer 36, it will be extremely difficult to doctor the missing color.

It will be understood that various modifications can be made to the exemplary embodiment disclosed herein without departing from the spirit and scope of the present invention. Also, the drawings herein are pictorial and not necessarily drawn to scale.

We claim:

1. A sealable plastic safety envelope for the conveyance of valuable documents that can be sealed by a sender and inspected by a recipient for indications of tampering or a tampering attempt undertaken by one or more of a variety of tampering techniques, the envelope comprising;

front and back panels of substantially equal length made of plastic material and defining a chamber and comprising front and back portions that comprise upper edges defining a laterally extending mouth opening to said chamber, each of said front and back portions having an inner and an outer surface, and said front portion having a lip region extending laterally coincident with the mouth and from the mouth downward a predetermined approximate distance from the mouth, a tamper evident header having a back section secured across the outer surface of said back portion and a front section extending upward beyond said back portion for folding over said edges, an outer adhesive layer coating said front section for securing said front section to said front panel outer surface and extending substantially across said lip region when said outer adhesive layer is pressed thereto, said outer adhesive layer being located on said header to contact and extend across said edges when said front section is secured to said lip region, an inner adhesive layer for sealing together said inner surfaces of said lip region and back portion and closing said chamber, said inner adhesive layer coating said inner surface of and extending laterally substantially across said back portion, said inner adhesive layer having a lowest boundary, and a release liner for protecting said outer and inner adhesive layers from unwanted adhesion being releasably secured to and covering said outer and inner adhesive layers, and wherein said outer surface of said frontportion includes indicia so located to aid the sender where to fold and press the free edge of said header on to said front portion, and said outer adhesive layer when said header is properly folded relative to said indicia and pressed on to said front portion having a lowest boundary that would be located above said lowest boundary of said inner adhesive layer and said outer adhesive lowest boundary would overlie said inner adhesive layer, and wherein after the envelope is closed and sealed, said inner adhesive layer prevents access to items within the chamber if a tamper tool penetrates or blade cuts through said header and said lip region.

2. A scalable plastic safety envelope according to claim 1, wherein said outer adhesive layer extends across said back panel portion for securing said back section to said back panel outer surface.

3. A sealable plastic safety envelope according to claim 1, wherein said header is made of material and has a thickness that shrivels with the application, to the header, of heat and becomes more frangible with the application to the header of cold temperature, whereby if after application of cold elements to the header the header is successfully raised, the outer adhesive layer remains on the outer envelope surface overlying the internal inner adhesive layer and further application of cold elements to release the internal layer must be applied to the exposed outer adhesive layer.

4. A sealable plastic safety envelope according to claim 1, wherein said header comprises an inner surface to which said outer adhesive layer is secured, said inner surface having thereon a first printed layer in a first color and having thereon a second printed layer in a second color, and said outer adhesive layer being secured to said inner header surface and covering said first and second printed layers.

5. A sealable plastic safety envelope according to claim 4, wherein said first printed layer comprises indicia that repeats in a predetermined pattern and said second printed layer comprises a flood coat covering said first printed layer.

6. A sealable plastic safety envelope according to claim 5, wherein random portions of said first and second printed layers will adhere to said outer adhesive surface in the event tampering successfully pulls back said header from said outer adhesive layer.

7. A sealable plastic safety envelope according to claim 6, wherein said outer adhesive layer comprises a third color and said header is sufficiently transparent to enable a recipient to see the third color or the absence of a combination of the second and third color in the event the header is removed from the outer adhesive layer and replaced at a slightly different position on the outer adhesive layer.

8. A sealable plastic safety envelope for the conveyance of valuable documents that can be sealed by a sender and inspected by a recipient for indications of tampering or a tampering attempt undertaken by one or more of a variety of tampering techniques, the envelope comprising:

font and back panels of substantially equal length defining a chamber and comprising front and back portions that comprise upper edges defining a laterally extending mouth opening to said chamber, each of said front and back portions having an inner and an outer surface, a tamper evident header having a back section secured laterally across the outer surface of said back portion and a front section extending upward beyond the back portion upper edge, an outer adhesive layer coating said front section for securing said front section to said front panel outer surface when said outer adhesive layer is pressed thereto and being located to contact both said edges when said outer adhesive layer is pressed thereto, an inner adhesive layer for sealing together said inner surfaces of said front and back portions and closing sad chamber, said inner adhesive layer coating said inner surface of and extending laterally substantially across said back portion, said inner adhesive layer having a lowest bound, and a release liner for protecting said outer adhesive layer from unwanted adhesion being releasably secured to and covering said outer layer, and wherein said header comprises inner and outer surfaces, said inner surface having thereon a first printed layer in a first color and having a second printed layer on one of said first printed layer and outer header surface in a second color, said outer adhesive layer being mounted to said inner header surface on one of said first and second printed layers, and wherein said outer surface of said front portion includes indicia so located to aid the sender where to fold and press the free edge of said header onto said front portion, and said outer adhesive layer when said header is properly folded relative to said indicia and pressed onto said front portion having a lowest boundary that would be located above said lowest boundary of said inner adhesive layer and said outer adhesive layer lowest boundary would overlie said inner adhesive layer, and wherein after the envelope is closed and sealed said inner adhesive layer prevents access to items within the chamber if a tamper tool penetrates or blade cuts through said header and said front portion.

9. A sealable plastic safety envelope according to claim 8, wherein said first printed layer comprises indicia that repeat in a predetermined pattern and said second printed layer comprises a translucent flood coat covering one of said first printed layer and said header outer surface.

10. A sealable plastic safety envelope according to claim 9, wherein said second printed layer overlies said first printed layer on the header inner surface and wherein portions of said first and second printed layers will adhere to said outer adhesive layer in the event tampering successfully pulls back said header from said outer adhesive layer.

11. A sealable plastic safety envelope according to claim 10, wherein said outer adhesive layer comprises a third color and said header is sufficiently transparent to enable a recipient to see the combination of the third and second colors when the outer adhesive layer is sealed to the front panel and enabling the recipient to see the absence of the combination of the second and third colors in the event the header is successfully removed from and then replaced on the outer adhesive layer.

12. A sealable plastic safety envelope according to claim 8, wherein said first printed layer comprises indicia that repeat in a predetermined pattern and said second printed layer comprises a translucent flood coat printed on said inner header surface.

13. A sealable plastic safety envelope according to claim 8, wherein said outer adhesive layer comprises a third color and cracks and includes pieces that release from the envelope front panel when chilled to the extent necessary to cause the inner adhesive layer to release.

14. A sealable plastic safety envelope for the conveyance of valuable documents that can be sealed by a sender and inspected by a recipient for indications of tampering or a tampering attempt undertaken by one or more of a variety of tampering techniques, the envelope comprising:

front and back panels defining a chamber and having front and back portions comprising upper edges defining a laterally extending mouth opening to said chamber, each of said front and back portions having an inner and an outer hole-free surface respectively, a tamper evident header having a back section secured laterally across the outer surface of said back portion and a front section extending beyond the back portion upper edge, an outer adhesive layer coating said front section for securing said front section to said front portion when said outer adhesive layer is pressed thereto, an inner adhesive means for sealing said inner surfaces of said front and back portions together to close the chamber and for preventing access to documents within the chamber if a tamper tool penetrates or blade cuts either (i) through said header and said front portion or (ii) through said header and said back portion, said inner adhesive means coating said inner surface of and extending laterally substantially across said back portion and said inner adhesive layer-having a lower portion that extends lower than that portion of the back section that is secured to said back portion and lower than that portion of the front section that becomes secured to said front portion when said header is properly positioned over and pressed toward said front portion, a release liner for protecting said outer adhesive layer from unwanted adhesion being releasably secured to and covering said outer adhesive layer, and wherein said header comprises inner and outer surfaces, said outer adhesive layer being secured to said inner header surface.

15. A sealed plastic safety envelope for the conveyance of valuable documents that had been sealed by a sender for inspection by a recipient for indications of tampering or a tampering attempt undertaken by one or more of a variety of tampering techniques, the envelope comprising:

front and back panels of substantially equal lengths defining a chamber and comprising front and back portions, said front and back portions comprising upper edges forming part of a laterally extending closed and sealed mouth of said chamber, each said portion having an inner and an outer hole-free surface respectively, a tamper evident header having a back section secured laterally across the outer surface of said back portion and a front section secured across the outer surface of said front portion, an outer adhesive layer for securing said front section to said front portion outer surface and said back section to said back portion outer surface and said outer adhesive layer being in contact with and sealing both said edges, an inner adhesive means sealing the mouth by sealing the inner surfaces of said front and back portions to each other and for preventing access to documents within the chamber if a tamper tool penetrates or blade cuts either (i) through said header and said front portion or (ii) through said header and said back portion, said inner adhesive means extending laterally substantially across said front and back panel portions and having a lower boundary positioned below said outer adhesive layer on said front portion and below said outer adhesive layer on said back portion.

16. A sealed plastic safety envelope according to claim 15, wherein said outer adhesive layer extends laterally substantially through said back portion for securing said back section to said back portion outer surface.

17. A sealed plastic safety envelope according to claim 15, wherein said header is made of material and has a thickness that shrivels with the application to the header of heat and becomes frangible with the application to the header of cold temperature, whereby if after application of cold elements to the header the header is successfully raised, the outer adhesive layer remains on the outer envelope surface overlying the inner adhesive means and further application of cold elements to release the inner adhesive means must be applied to the exposed outer adhesive layer.

18. A sealed plastic safety envelope according to claim 17, wherein said header is formed of acetate material.

19. A sealed plastic safety envelope according to claim 18, wherein said header is approximately one millimeter thick.

20. A sealed plastic safety envelope according to claim 15, wherein said header comprises an inner surface and an outer surface, said inner header surface having thereon a first printed layer in a first color, and a second printed layer in a second color printed on one of the inner header surface and the outer header surface, said outer adhesive layer being mounted to said inner header surface.

21. A sealed plastic safety envelope according to claim 20, wherein said first printed layer comprises indicia that repeats in a predetermined pattern and said second printed layer comprises a translucent flood coat.

22. A sealed plastic safety envelope according to claim 21 wherein random portions of said first printed layer will adhere to said outer adhesive surface in the event tampering pulls back a header portion from said outer adhesive layer without tearing or breaking said header.

23. A sealed plastic safety envelope according to claim 22, wherein said outer adhesive layer comprises a third color for visually combining with said second color whereby parts of said outer adhesive layer break away if cold temperature elements are applied through the outer adhesive layer to sufficiently chill and release the inner adhesive layer and thereby leave an absence of the third color under the header when the header is replaced on the outer adhesive layer.

24. A sealed plastic safety envelope according to claim 15, wherein said header comprises an inner header surface and an outer header surface, said outer adhesive layer being secured to said inner header surface, said inner header surface having thereon a first printed layer in a first color, said outer printed surface having a second printed layer in a second color.

25. A sealed plastic safety envelope according to claim 24, wherein said inner header surface is treated to release the first printed layer to said inner adhesive means upon peel-back and said first printed layer forms indicia.

26. A sealed plastic safety envelope according to claim 25, wherein said second printed layer is non-releasable from said outer header surface and comprises a translucent flood coat.

* * * * *

UNITED STATES PATENT AND TRADEMARK OFFICE

CERTIFICATE OF CORRECTION

PATENT NO. : 5,918,983
DATED : July 6, 1999
INVENTOR(S) : John Palazzolo

It is certified that error appears in the above-indentified patent and that said Letters Patent is hereby corrected as shown below:

Col. 7, Line 1, change "frontportion" to --front portion--.

Col. 7, Line 15, change "scalable" to --sealable--.

Col. 7, Line 57, change "font" to --front--.

Signed and Sealed this

Second Day of November, 1999

*Attest:*

Q. TODD DICKINSON

*Attesting Officer*

*Acting Commissioner of Patents and Trademarks*